United States Patent [19]

Tate

[11] Patent Number: 4,794,036

[45] Date of Patent: Dec. 27, 1988

[54] STAINPROOF WOVEN FABRIC FOR PAPER MAKING AND METHOD FOR MAKING THE SAME

[75] Inventor: Takuo Tate, Hachioji, Japan

[73] Assignee: Nippon Filcon Co., Ltd., Tokyo, Japan

[21] Appl. No.: 112,996

[22] Filed: Oct. 26, 1987

[30] Foreign Application Priority Data

Mar. 18, 1987 [JP] Japan ..... 62-61382

[51] Int. Cl.[4] ..... B32B 7/00

[52] U.S. Cl. ..... 428/263; 427/316; 427/322; 427/412; 427/419.8; 428/265; 428/267

[58] Field of Search ..... 428/263, 265, 267; 427/316, 322, 412, 419.8

[56] References Cited

U.S. PATENT DOCUMENTS 4,680,212 7/1987 Blyth et al. ..... 428/97

*Primary Examiner*—Marion C. McCamish

*Attorney, Agent, or Firm*—Bucknam and Archer

[57] ABSTRACT

A stainproof woven fabric for use as a wire in paper making, which comprises a woven fabric made of synthetic resin monofilaments as warp and weft, and a cation-exchangeable synthetic resin film which has metallic ions adsorbed therein and is formed on the monofilaments of the woven fabric; and a method for making the stainproof fabric, which comprises providing a woven fabric made of synthetic monofilaments as warp and weft, thermally setting the woven fabric flat, applying an ingredient or ingredients capable of forming a cation-exchangeable synthetic resin to the thermally set woven fabric, curing the thus applied ingredient or ingredients to form a cation-exchangeable synthetic resin film on the woven fabric and then bringing the resin film-formed woven fabric into contact with an aqueous solution containing metallic ions to have the metallic ions adsorbed in the resin film thereby obtaining the stainproof woven fabric.

10 Claims, No Drawings

STAINPROOF WOVEN FABRIC FOR PAPER MAKING AND METHOD FOR MAKING THE SAME

BACKGROUND OF THE INVENTION

1. Field of the Invention

This invention relates to an endless stainproof woven fabric which is woven from monofilaments of synthetic resins and is used for paper making. More particularly, it relates to such a woven fabric which is suitable for use as a wire in making paper, e.g. kraft paper, corrugating medium paper, liner boards or paperboards from waste paper containing gum pitches by reclamation thereof. The invention also relates to a method for making such a woven fabric as mentioned above.

2. Description of the Prior Art

Unlike metallic wires, synthetic resin-made woven fabrics for paper making, when used as wires, are disadvantageously apt to stain due to the deposition thereon of tacky particles called gum pitch, which is a kind of resin contained in starting waste paper. To avoid this, a variety of methods have been proposed and have actually been in use. In one such method, a resin film made of a mixture of a fluorine resin powder with a thermosetting resin is formed on the surfaces of yarns of a woven fabric. Another method is described in U.S. Pat. No. 3,573,089 in which a hydrophilic resin film is formed similarly to the previous method. The former method in which a resin film containing a fluorine resin powder is formed on the yarns is an attempt to make use of the non-tackiness of the fluorine resin. Since the fluorine resin itself cannot adhere directly to the surfaces of the yarns of the woven fabric, a resin used as a binder is essential. In this case, the fluorine resin powder is buried in the binder resin whereby it is difficult for the former to be exposed to the surface of the resin film, so that the stainproof effect caused by the non-tackiness inherent to the fluorine resin is not fully exhibited.

In the latter method in which a hydrophilic resin film is formed on the surfaces of the yarns of a woven fabric, the resin film so formed is poor in water resistance, resulting in the loss of the stainproof effect within a short time due to the elution of the hydrophilic material although the effect is appreciated initially.

As will be apparent from the above, the known stainproof methods have never provided stainproof fabrics which can maintain their stainproof effect throughout their service life. In paper-making industries, stained woven fabrics have to be frequently washed forcibly by the use of chemicals or highly pressurized shower. This places on the part of the makers substantial burdens including the damage of the woven fabrics and the loss time caused by suspending the operation of paper-making machines.

SUMMARY OF THE INVENTION

It is an object of the invention to provide a woven fabric for paper making which can overcome the drawbacks of the prior art and which can maintain its stainproof property over a long term throughout its service life.

It is another object of the invention to provide a method for making such a woven fabric as mentioned above.

The present invention contemplates to provide stainproof woven fabrics for paper making which are produced by interweaving polyamide-, polyester- or other synthetic resin-made monofilaments as warp and weft to obtain a woven fabric and then forming on the surfaces of the monofilaments of the woven fabric a cation-exchangeable synthetic resin film on which metallic ions have previously been adsorbed, as well as to provide a method for the production of the stainproof woven fabrics.

The woven fabrics used in the present invention may have any textile texture, may be made of at least one kind of synthetic resin monofilaments and/or may be in the form of single weave, double weave or triple weave. In brief, every known information on, and every known technique of, the production of woven fabrics can be applied, without specific limitations, to the production of the woven fabrics used in the present invention.

As is well known in the art, woven fabrics for paper making are, in most cases, used in the form of an endless belt except for specific such ones. Such an endless woven fabric may be produced for instance by joining together the opposite ends of a woven fabric or weaving filaments or fibers into a tubular fabric. Thus, none of methods for producing an endless woven fabric are particularly limited for use in making an endless woven fabric according to the present invention. The preeent invention is characterized in that monofilaments constituting the woven fabric are covered on their surfaces with a cation-exchangeable synthetic resin film in which metal ions have been adsorbed.

DESCRIPTION OF THE PREFERRED EMBODIMENTS

In the practice of the invention, the cation exchangeable synthetic resin film is formed by several methods including a method which comprises coating a woven fabric with an ingredient or ingredients capable of forming a cation-exchangeable synthetic resin by polymerization or condensation polymerization and then subjecting the coated ingredient or ingredients to polymerization or polycondensation, and a method which comprises coating a woven fabric with a mixture of such a cation-exchangeable synthetic resin (in a powder form) and other synthetic resin serving as a binder to form a film on the respective monofilaments of the woven fabric.

In the former method which comprises forming a cation-exchangeable synthetic resin film by applying to a woven fabric an ingredient or ingredients capable of producing a cation-exchangeable synthetic resin by polymerization or polycondensation and subjecting the applied ingredient or ingredients to polymerization or polycondensation thereby to form on the woven fabric such a resin film as mentioned above, phenolsulfonic acid/phenol-formaldehyde condensed resins or styrenesulfonic acid/divinylbenzene copolymer resins may be used as the cation-exchangeable synthetic resin. When the phenol-sulfonic acid/phenol-formaldehyde condensed resins are to be used as the cation-exchangeable resin, it is most convenient that a precondensate of phenolsulfonic acid and formaldehyde and a precondensate of phenol and formaldehyde are mixed together and diluted with water or an organic solvent, applied onto a woven fabric and then cured. As a matter of course, other synthetic resins or softening agents may be added to the mixture.

On the other hand, when a copolymer resin of styrenesulfonic acid and divinylbenzene is to be used as the cation-exchangeable resin, these two monomeric ingredients are mixed together, diluted with a solvent if necessary, applied onto a woven fabric and then cured. In this case, other synthetic resins or softening agents may also be added.

The resins or curable ingredients so applied onto the woven fabric are heated, during which they are dried and polycondensed or polymerized to form a cation-exchangeable synthetic resin film.

In the latter method in which a mixture of a preliminarily polycondensed cation-exchangeable resin powder and other synthetic resin used as a binder is applied onto a woven fabric to form a film of the mixture on the surfaces of the respective component monofilaments, there are used known cation-exchangeable resins such as phenolsulfonic acid resins obtained by polycondensation of phenolsulfonic acid-phenol-formaldehyde, styrenesulfonic acid-divinylbenzene copolymer resins, sulfonated polystyrene-divinylbenzene copolymer resins, and methacrylic acid-divinylbenzene copolymer resins. Of these, the sulfonic acid type resins are preferred for the purpose of the invention in view of the metallic ion adsorptivity and the pH range used. The cation-exchangeable resins may preferably be used in the form of powder finer than 400 mesh. The powdery cation-exchangeable resin is mixed with a binder resin and applied onto the surface of the component monofilaments of a woven fabric to form a film of the resin. Examples of the binder resins are polyvinyl alcohol, vinyl acetate-ethylene copolymers, ethylene-acrylic ester copolymers, polyacrylic resins, polyamide resins, saturated polyester resins, phenolic resins and epoxy resins.

The binder resin is treated to form a solution or dispersion thereof, mixed with a cation-exchangeable resin powder, applied onto a woven fabric and then dried or thermally cured to form a synthetic resin film on the woven fabric as desired. The mixing ratio of the cation-exchangeable resin to the binder resin may vary depending upon the ion exchange capacity of the cation-exchangeable resin and is generally in the range of 7 to 30 parts by weight of the cation-exchangeable resin per 100 parts by weight of the synthetic resin binder.

The cation-exchangeable resin film can be formed on the surfaces of the monofilaments of a woven fabric according to the method described above. Since the woven fabric for paper making is usually employed under very severe conditions, the film should have strength sufficient to withstand the severe conditions. A larger ion exchange capacity of the film-forming resin generally results in a more brittle resin film. Thus, the cation-exchangeable resin usable in the present invention has to be used in such a way that its exchange capacity is kept considerably lower than is ordinarily known in the art. For instance, the ion exchange capacity of the resin film according to the invention is generally in the range of from 0.3 meq/g to 3.0 meq/g (dried resin). With resins whose ion exchange capacity is less than 0.3 meq/g, a satisfactory metallic ion absorption necessary for the stainproofing cannot be attained. On the other hand, when the exchange capacity is larger than 3.0 meq/g, a high film strength cannot be obtained with a low water resistance, thus being unfavorable in view of the severe paper-making conditions.

In the present invention, the cation-exchangeable resin film formed on the surfaces of the component monofilaments of a woven fabric has metallic ions adsorbed on said surfaces prior to its use. This can be done, for example, by a method which comprises forming a cation-exchangeable film on the component monofilaments of the woven fabric and then having metallic ions adsorbed on the thus formed film, or by a method which comprises forming a cation-exchangeable resin film on the component monofilaments of the woven fabric, setting up the resin film-formed woven fabric on a paper-making machine and then having metallic ions adsorbed in the resin film just prior to commencement of paper-making operations. The adsorption of metallic ions on the cation-exchangeable resin film may be easily effected by immersion of the woven fabric in an aqueous solution containing metallic ions, by application of the solution to the fabric or by spraying the solution over the fabric.

The aqueous solution containing metallic ions may be an aqueous solution of, for example, a metal chloride, metal hydroxide or the like, an acidic solution of any one of the compounds mentioned above, or industrial water having a large content of metallic ions. The metallic ions usable in the present invention may be obtained from almost any metals which are able to produce cations in water, among which iron, nickel, copper and like ions existing in large amounts in the natural world are more convenient for use. The amount of these metallic ions adsorbed in the cation-exchangeable resin film may be in the range of from 3 to 30% equivalent of the ion exchange capacity of the ion-adsorbed resin in a dried state to exhibit a satisfactory stainproof effect on the woven fabric.

When the cation-exchangeable synthetic resin film adsorbing metallic ions therein and formed on the individual monofilaments of the woven fabric is placed in paper stock, it will exhibit surface properties similar to those of metals, i.e. wettability and potential characteristics which are imparted to the film. Moreover, the remaining ion-exchange capacity which is at least 70% equivalent of the total ion exchange capacity of the cation-exchangeable resin enables the charge on the surfaces of the woven fabric to be negative. Accordingly, metallic ions floating in the water of the paper stock are drawn to and concentrated on the surface of the woven fabric, thereby preventing the contact between dirt components and the woven fabric surface. Because the woven fabric is charged negatively on the surfaces thereof and the dirt components are usually charged negatively, the fabric and the dirt repulse each other, rendering it difficult to bring them into contact. This leads to the fact that the dirt components do not deposit on the woven fabric. In this sense, the woven fabric for paper making according to the invention is a stainproof woven fabric which is very suitable for making paper re-utilizing waste paper containing gum pitches.

The present invention will be better understood by the following non-limitative examples.

EXAMPLE 1

A endless woven fabric having a 1/1 plain weave structure which was made of nylon monofilaments each having a diameter of 0.3 mm as warp and nylon monofilaments each having a diameter of 0.35 mm as weft and which had a warp density of 20 monofilaments/cm and a weft density of 18 monofilaments/cm, was thermally set flat in a usual manner. A vinyl acetate-polyethylene copolymer resin was dissolved in toluene to obtain a 7 wt. % solution in which a 600 mesh pass powder of a cation-exchangeable styrenesulfonic acid type resin having an ion exchange capacity of 4.8 meq/g (dry resin) was dispersed in an amount of 15 parts by weight per 100 parts by weight of the copolymer resin. The resulting dispersion was sprayed onto one surface of the endless woven fabric which was to be in contact with pulp fibers on a paper-making machine and then dried at 100° C. Thereafter, the thus sprayed woven fabric was immersed in an 0.1N aqueous solution of ferric chloride for 12 hours, washed with water and dried. The resultant stainproof woven fabric had a warp density of 23 monofilaments/cm and a weft density of 17 monofilaments/cm and had a synthetic resin film formed on the component monofilaments thereof, the resin film having an ion exchange capacity of 0.45 meq/g (dry resin) and an adsorbed iron metal content of 1.7 mg/g (dry resin).

When the thus obtained stainproof woven fabric was used for making a corrugating medium paper from a 100% waste paper stock, it was found that dirt was deposited on the woven fabric in an amount of as small as 1.8 g/m$^2$ during initial three days while with a conventional woven fabric, the deposition was 4.1 g/m$^2$.

EXAMPLE 2

An endless woven fabric made of a 3/1 satin weave which was constituted of, as warp, polyester monofilaments each having a diameter of 0.20 mm and, as weft, polyester monofilaments each having a diameter of 0.25 mm and which had a warp density of 25 monofilaments/cm and a weft density of 20 monofilaments/cm, was thermally set in a usual manner. Phenol and a phenolsulfonic acid/formaldehyde precondensate were mixed together in a ratio by weight of 1:1 and dissolved in an alcohol to obtain an alcohol solution having a total concentration of 5 wt. %. This solution was applied onto the woven fabric by means of a roll coater, dried and cured at 120° C. Subsequently, the processed woven fabric was washed with water shower and immersed in an 0.1N aqueous solution of ferric chloride for 6 hours. The resultant stainproof woven fabric had a warp density of 30 monofilaments/cm and a weft density of 20 monofilaments/cm and the synthetic resin film formed on the component monofilaments had an ion exchange capacity of 2.0 meq/g (dried resin) and an adsorbed iron ion content of 2.8 mg/g (dried resin).

When this stainproof woven fabric was used for making paper from an intermediate layer (in which dirt components were contained in the largest amount) on a paperboard making machine (Ultraformer), it was found that while a conventional woven fabric had 5.0 g/m$^2$ of dirt deposited thereon during the first three days, the stainproof woven fabric of this invention allowed only 0.8 g/m$^2$ of dirt to deposit thereon under the same conditions. Although the conventional woven fabric required chemical washing once a week, the woven fabric of the invention did not require any washing over a time period of 50 days.

What is claimed is:

1. A stainproof woven fabric for paper making, characterized in that an original woven fabric for the stainproof woven fabric is made of synthetic resin monofilaments as warp and synthetic resin monofilaments as weft, and a cation-exchangeable synthetic resin film having metallic ions adsorbed therein is formed on the surfaces of the component monofilaments of the original woven fabric to obtain the stainproof woven fabric.

2. A stainproof woven fabric according to claim 1, wherein the cation-exchangeable synthetic resin film formed on the surfaces of the monofilaments prior to adsorption of the metallic ions in the resin film is one obtained by polycondensation on the original woven fabric.

3. A stainproof woven fabric according to claim 2, wherein the cation-exchangeable synthetic resin film is made of a phenolsulfonic acid-phenol-formaldehyde polycondensate resin.

4. A stainproof woven fabric according to claim 2, wherein the cation-exchangeable synthetic resin film is made of a styrenesulfonic acid-divinylbenzene copolymer resin.

5. A stainproof woven fabric according to claim 1, wherein the cation-exchangeable synthetic resin film is made of a synthetic resin as a binder and a cation-exchangeable resin powder mixed with the binder.

6. A stainproof woven fabric according to claim 5, wherein said cation-exchangeable resin powder is made of a sulfonic acid type ion-exchange resin.

7. A stainproof woven fabric according to claim 1, wherein said cation-exchangeable synthetic resin film has an ion exchange capacity of from 0.3 meq/g to 3.0 meq/g on a dry resin basis.

8. A stainproof woven fabric according to claim 1, wherein said cation-exchangeable synthetic resin film has an adsorbed metallic ion content of from 3 to 30% equivalent of the ion exchange capacity of said film.

9. A method for making a stainproof woven fabric for paper making, which comprises:

providing an endless woven fabric made of synthetic resin monofilaments as warp and weft, thermally setting the endless woven fabric flat, applying at least one ingredient capable of producing a cation-exchangeable synthetic resin to the thermally set woven fabric, curing the thus applied ingredient or ingredients to form a cation-exchangeable synthetic resin film on the surfaces of the monofilaments of the woven fabric, and then bringing the resin film-formed woven fabric into contact with an aqueous solution containing metallic ions to have the metallic ions adsorbed in the synthetic resin film prior to use in paper making thereby obtaining the stainproof woven fabric.

10. A method according to claim 9, wherein the at least one ingredient capable of forming a cation-exchange synthetic resin is a phenolsulfonic acid-phenol-formaldehyde condensate, a mixture of styrenesulfonic acid with divinylbenzene, or a combination of a phenolsulfonic acid-phenol-formaldehyde polycondensate or a styrenesulfonic acid-divinylbenzene copolymer with, as a binder, polyvinyl alcohol, a vinylacetate-ethylene copolymer resin, an ethylene-acrylic acid ester copolymer resin, a polyacrylic acid resin, a polyamide resin, a saturated polyester resin, a phenol resin or an epoxy resin.

* * * * *